US009863424B2

(12) United States Patent
Homstvedt

(10) Patent No.: US 9,863,424 B2
(45) Date of Patent: Jan. 9, 2018

(54) SEALED PUMP

(71) Applicant: Aker Subsea AS, Lysaker (NO)

(72) Inventor: Gunder Homstvedt, Houston, TX (US)

(73) Assignee: Aker Subsea AS, Lysaker (NO)

( * ) Notice: Subject to any disclaimer, the term of this patent is extended or adjusted under 35 U.S.C. 154(b) by 0 days.

(21) Appl. No.: 14/655,835

(22) PCT Filed: Jan. 10, 2014

(86) PCT No.: PCT/NO2014/050004
§ 371 (c)(1),
(2) Date: Jun. 26, 2015

(87) PCT Pub. No.: WO2014/109648
PCT Pub. Date: Jul. 17, 2014

(65) Prior Publication Data

US 2015/0354574 A1 Dec. 10, 2015
US 2016/0186759 A2 Jun. 30, 2016

(30) Foreign Application Priority Data

Jan. 10, 2013 (NO) ..... 20130054

(51) Int. Cl.
*F04D 13/08* (2006.01)
*F04D 13/06* (2006.01)
(Continued)

(52) U.S. Cl.
CPC ..... *F04D 13/062* (2013.01); *F04D 13/024* (2013.01); *F04D 13/086* (2013.01); *F04D 25/026* (2013.01); *F04D 29/044* (2013.01)

(58) Field of Classification Search
CPC .. F04D 29/5806; F04D 29/588; F04D 29/108; F04D 29/128; F04D 13/0653;
(Continued)

(56) References Cited

U.S. PATENT DOCUMENTS 6,379,127 B1 4/2002 Andrews et al.
6,457,950 B1 * 10/2002 Cooper ..... F04C 2/16 417/366

(Continued)

FOREIGN PATENT DOCUMENTS

EP 2134969 A1 12/2009
GB 2390750 B 3/2005

(Continued)

OTHER PUBLICATIONS

Bergheim, Olav, "International Search Report" for PCT/NO2014/050004, dated Apr. 7, 2014, 3 pages.

*Primary Examiner* — Nathan Zollinger
(74) *Attorney, Agent, or Firm* — Winstead PC

(57) ABSTRACT

A subsea pump, distinctive in that it comprises a pressure housing divided into two compartments; a compartment with pump or impellers arranged on a shaft and a compartment with motor or a stator; a diaphragm arranged sealingly between the compartments, a magnetic coupling between the compartments, through the diaphragm; and a pressure compensation system for balancing the pressure on the diaphragm of the motor or stator compartment side to the pressure on the diaphragm of the pump or impeller compartment side.

7 Claims, 3 Drawing Sheets

Figure 1:
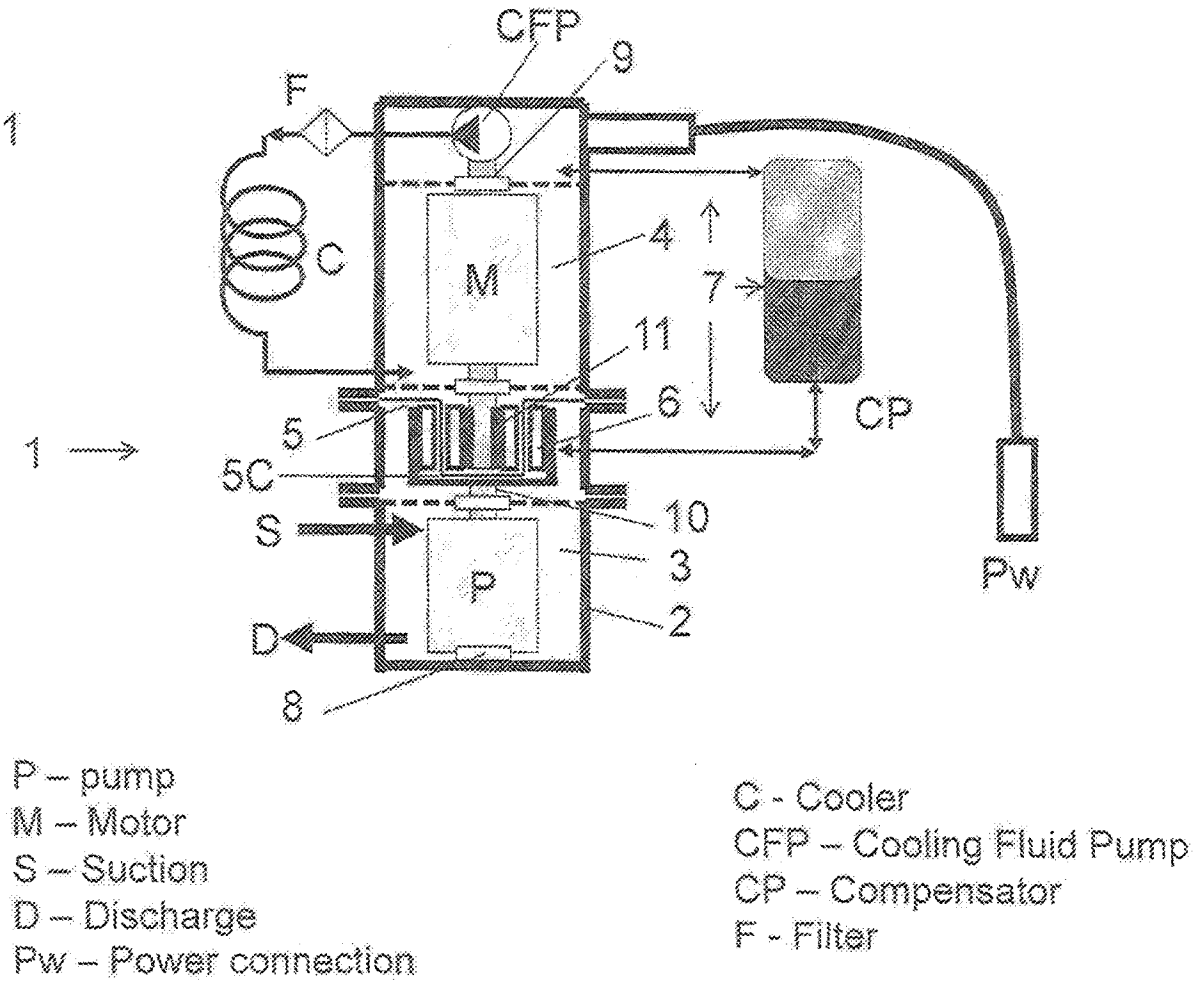

P – pump
M – Motor
S – Suction
D – Discharge
Pw – Power connection

C - Cooler
CFP – Cooling Fluid Pump
CP – Compensator
F - Filter

(51) Int. Cl.
*F04D 25/02* (2006.01)
*F04D 13/02* (2006.01)
*F04D 29/044* (2006.01)

(58) Field of Classification Search
CPC ..... F04D 13/08; F04D 13/086; F04D 13/021; F04D 13/024; F04D 13/062; F04D 29/044; F04D 25/026
USPC ..... 417/420
See application file for complete search history.

(56) References Cited

U.S. PATENT DOCUMENTS

| | | | | |
|---|---|---|---|---|
| 7,156,627 | B2 * | 1/2007 | Lenderink | F04D 25/0606 417/423.8 |
| 8,113,792 | B2 * | 2/2012 | De Boer | F04D 25/06 417/228 |
| 8,523,540 | B2 * | 9/2013 | Eide | 310/52 |
| 2010/0129237 | A1 * | 5/2010 | Eide | F04D 29/586 417/410.1 |
| 2011/0058966 | A1 | 3/2011 | Cunningham et al. | |
| 2011/0274565 | A1 | 11/2011 | Tetzlaff | |
| 2014/0086764 | A1 * | 3/2014 | Stinessen | F04D 1/06 417/420 |

FOREIGN PATENT DOCUMENTS

| | | | | |
|---|---|---|---|---|
| WO | WO-2008127119 | A1 | 10/2008 | |
| WO | WO-2012/125041 | A1 | 9/2012 | |
| WO | WO 2012125041 | A1 * | 9/2012 | F04D 1/06 |

* cited by examiner

SEALED PUMP

FIELD OF THE INVENTION

The present invention relates to subsea pumps, more specifically pumps for pumping liquids like hydrocarbons for pressure boosting or water for injection, at subsea locations.

BACKGROUND OF THE INVENTION AND PRIOR ART

Driven by the urgent requirements of the oil and gas industry, subsea pressure boosting is a technology subject to extensive effort for further development. Due to the size, power and flow to be handled, and special requirements for operation subsea, solutions found viable for pumps for other applications may be useless subsea for the intended purpose.

For equipment subsea, reliability is usually the main issue of concern, due to huge technical, economic and environmental effects if the equipment fails.

Factors contributing to failure for new and existing subsea pump design concepts, include inter alia mechanical instability at the size and pressures required; too large pressure impacts at start, stop or abrupt load changes; breakdown of electrical insulation before expiry of design service life; accumulation of contaminations in the motor or bearings, and loss of control for several other reasons.

A promising design for improving subsea pumps is to implement a magnetic coupling between the electric motor and pump, by arranging a diaphragm or separation wall sealingly between the motor and pump, having the magnetic coupling through the diaphragm or wall. This is called a sealed pump design, since the motor is arranged in a sealed compartment.

For subsea pumps of the above mentioned type, this has however been more difficult than expected in practice, for several reasons.

Reference is made to the prior art patent publication GB 2 390 750 B, assumed to be the closest art to the present invention. Said publication describes and illustrates an electric submersible pumping (ESP) system, which shall be arranged in a wellbore for lifting the fluid collected in the well. The pump of GB 2 390 750 B has a sealed, oil filled motor housing, the motor housing is coupled magnetically through a sealing cylindrical wall to a pump, the dynamic stability of the magnetic coupling being enhanced by at least two radially spaced intermediate bearings respectively disposed inside and outside said cylindrical housing. Further, pressure balancing means maintain the pressure within the sealed housing to be substantially equal to the pressure in the wellbore. The ESP of GB 2 390 750 B must be very long in order to be feasible for operation in wellbores whilst still boosting the pressure substantially since the wellbore puts severe restrictions on the diameter.

Contamination and accumulation of particles in the bearings can make the above mentioned ESP less reliable. Particles or gas may destroy the bearing lubrication. The tendency of non-ferromagnetic metals and hence metal bearings to become ferromagnetic under stress and strain, may make the magnetic coupling ineffective. The pressure compensation of GB 2 390 750 B functions between the well pressure and the motor housing, implying that the pump side with bearings is exposed to the well flow directly and thereby severe contamination. In a typical well, the flowing well pressure may be from some 10th's to some 100th's of bar whilst the shut in pressure may be several 100th's bar higher, all of which must be handled by the pressure compensation system, and the resulting wall thicknesses or design pressure must be adapted accordingly since the pressure compensation system cannot be expected to work perfectly or instantaneously. A thick wall construction will be less efficient with respect to magnetic coupling.

A high relative speed will exist between the sealing wall and the outer and inner rotating member. This relative speed will result in hydrodynamically generated friction heat of substantial magnitude. No cooling or means for heat removal are described in GB 2 390 750 B. Other relevant art is found in the patent publications U.S. Pat. No. 6,379,127 B1, US 2011/0274565 A1 and WO 2012/125041 A1.

The main objective of the present invention is to provide a subsea pump that is more reliable than prior art subsea pumps, for operation as mentioned above.

SUMMARY OF THE INVENTION

The invention provides a subsea pump, distinctive in that it comprises a pressure housing divided into two compartments;

- a compartment with pump or impellers arranged on a shaft and
- a compartment with motor or a stator;
- a diaphragm arranged sealingly between the compartments,
- a magnetic coupling between the compartments, through the diaphragm; and
- a pressure compensation system for balancing the pressure on the diaphragm of the motor or stator compartment side to the pressure on the diaphragm of the pump or impeller compartment side.

Preferably, the pressure compensation system controls the differential pressure over the diaphragm to be less than 5 bar, preferably less than 3 bar, more preferable less than 1 bar, even more preferably less than 0.3 bar, most preferably about 0 bar, by balancing the pressures on either side of the wall. The pressure compensator is preferably based on and comprises metal bellows/diaphragms arranged in a cylinder housing, due to feasible stretching and contraction. The diaphragm sides are connected to respective cylinder sides to allow for a substantial volume to be compensated in short response time.

Preferably, the bearings are arranged with lubrication for protection against gas and particles, the lubrication flow flushes out any particles or debris whilst lubricating and cooling and particles are removed in a filter. The bearings are typically two radial and one thrust bearing in each compartment. The sealed compartments preferably include separate impellers for circulation of the lubrication fluid. For a sealed motor compartment, the liquid filling the compartment is void of particles and contamination initially, and the fluid is circulated inside the compartment, or if the requirement for cooling is high, through a separate cooler. For the pump compartment, any particles or contamination is flushed out with the pumped medium, an impeller for bearing flushing and lubrication has inlet at a location close to the rotational axis on the high pressure side of the pump impellers, at a location where the level of particles and contamination is assumed or modeled to be at a minimum. The same flushing fluid is used for cooling.

The motor compartment is preferably filled with water/glycol or glycol as motor coolant and lubricant for the bearings.

Preferably, the pump is vertically oriented and at least a part of the diaphragm has shape like a hat. A rotor arranged outside the hat is cooled by circulating fluid through radial conduits in the bottom of the rotor. Cooling for the inner rotor is arranged through an axial channel in the shaft coupled with radial holes at the bottom of the rotor. This circulation arrangement is also used to remove gas collected in top of the hat.

Alternatively, the pump is vertically oriented and at least a part of the diaphragm has shape like a cup. A rotor arranged inside the cup is cooled by circulating fluid through conduits arranged inside the rotor shaft and radially out through the rotor. Cooling of the outer rotor is done through radial conduits in the bottom of the rotor.

Preferably, all bearings are arranged axially apart from the magnetic coupling.

In a preferable embodiment, the motor compartment comprises a stator with the rotor arranged inside the diaphragm, thereby simplifying the design, eliminating one shaft. For this design, stator cooling is preferably provided by a coolant circuit sealingly coupled to an impeller on or connected to the pump shaft, alternatively by a separate external pump and coolant circuit or flow.

Preferably, the motor housing is filled with a water-glycol mixture, and the circulation pump is a water-glycol pump. Preferably, the pump requires no supply of barrier fluid from external sources, simplifying the system design since long supply lines are eliminated. Also, the pump has a short design compared to a downhole pump. The coolant in the motor cavity can preferably be filled or exchanged subsea by a Remotely Operated Vehicle (ROV), via specific flow ports to which the ROV can connect itself for exchanging coolant fluid, or by replacing a coolant tank and preferably also a filter by including ROV-operable connections and valves for isolating and disconnecting said parts and connecting new parts. Preferably, a tank and a filter are integrated so as to be replaced as one unit in a single operation.

The pump of the invention is more stable, robust, reliable and effective than prior art subsea pumps for the intended service, since the coupling area is better cleaned and cooled. The effective pressure compensation system allows a lower design differential pressure of the diaphragm, ensuring a thinner diaphragm or wall and a more effective magnetic coupling over the diaphragm. The sealed motor compartment allows an initial liquid filling for cooling and lubrication to last throughout a typical design life of for example 20 years. However, ports for replacement of said fluid can preferably be arranged, feasible for replacement filling and emptying by ROV from tanks or an umbilical deployed for the purpose, or for filling filtered regenerated glycol from the pump compartment, in case extended service life is desired or unexpected problems occur.

FIGURES

Figure 2:
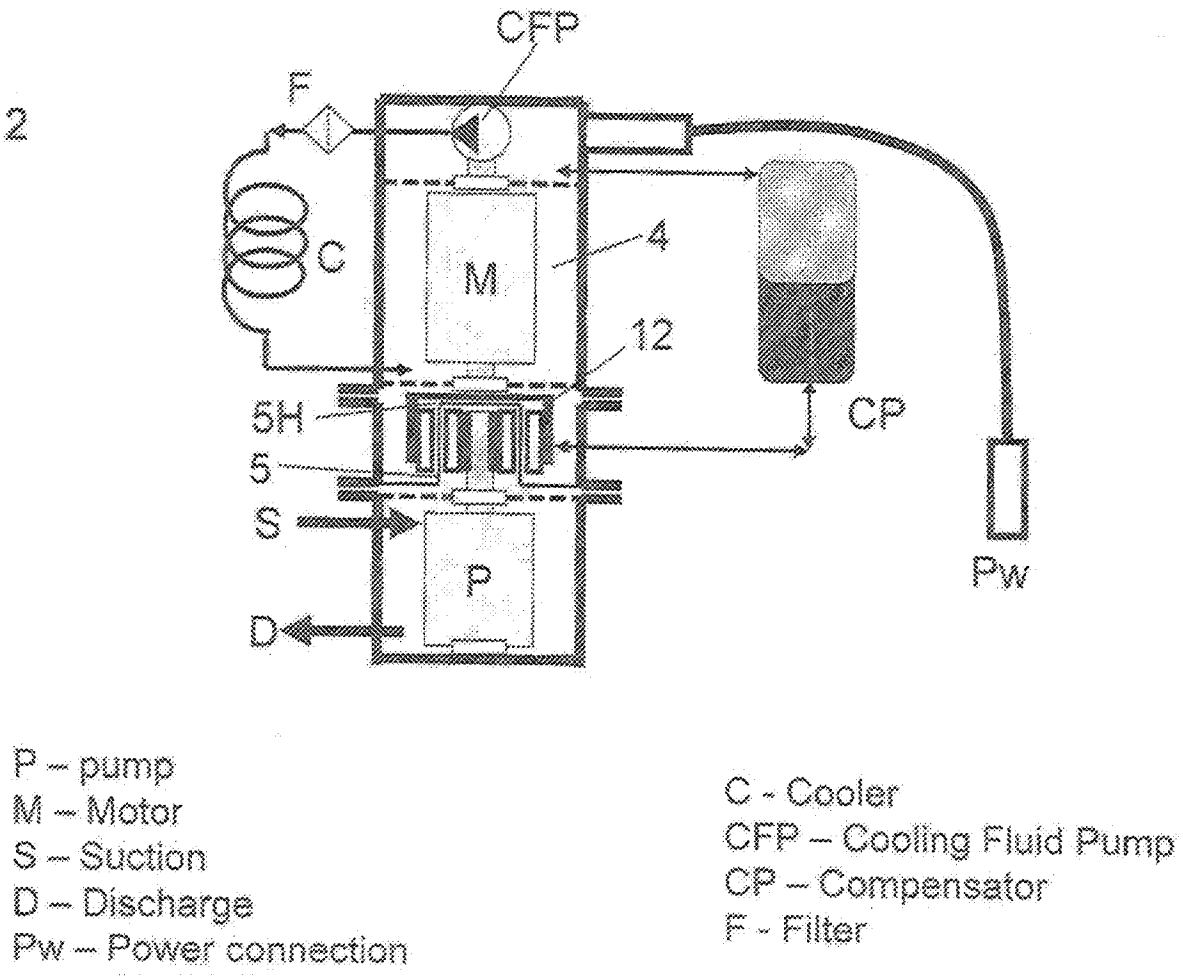

The invention is illustrated with three figures, namely:

FIG. 1 illustrating an embodiment of a pump of the invention,

FIG. 2 illustrating another embodiment of a pump of the invention, and

Figure 3:
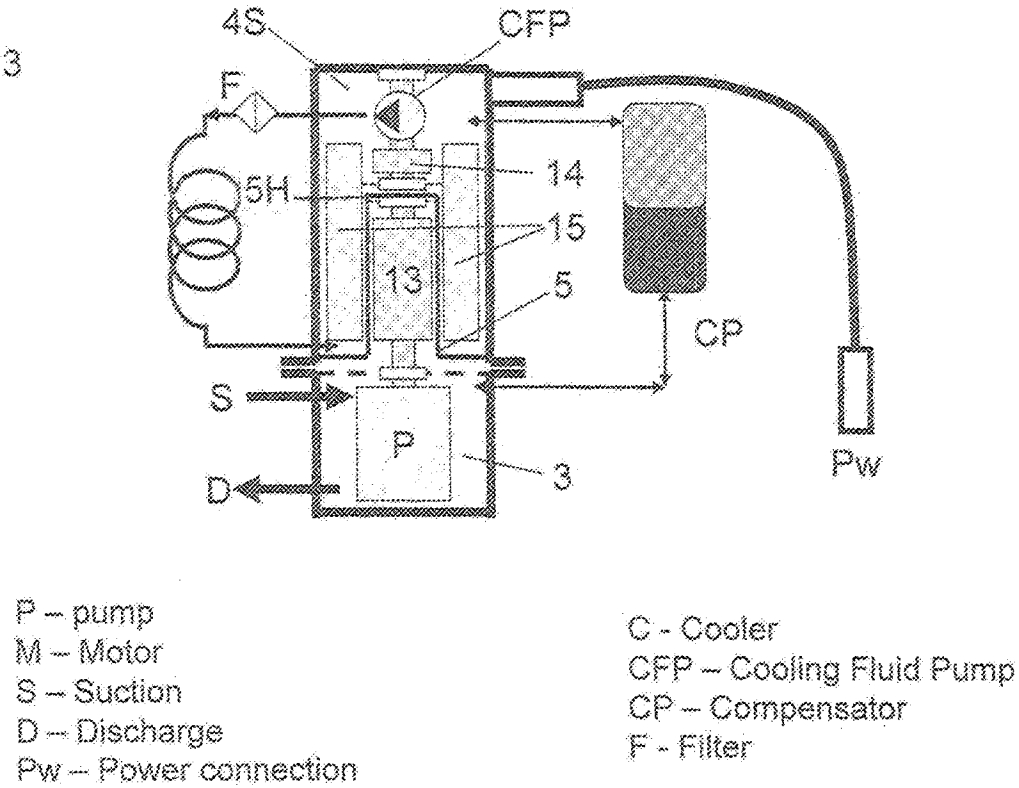

FIG. 3 illustrating a variation of the embodiment illustrated in FIG. 2.

DETAILED DESCRIPTION

Reference is made to FIG. 1, illustrating an embodiment of a pump 1 of the invention, arranged vertically standing. The pump 1 comprises a pressure housing 2 divided into two compartments; namely a compartment 3 with pump or impellers arranged on a shaft and a compartment 4 with motor or a stator. A diaphragm 5 separates the compartments sealingly, a magnetic coupling 6 provides coupling between the compartments, radially through a part the diaphragm 5 having shape and orientation as a cup 5C. A pressure compensation system 7 provides balancing of the pressure on either side of the diaphragm, which means pressure balancing of the motor or stator compartment side of the diaphragm to the pump or impeller compartment side of the diaphragm. Bearings 8 arranged outside the magnetic coupling, supports a motor shaft 9 in the motor compartment and a pump shaft 10 in the pump compartment, respectively. A coupling-rotor 11 arranged inside the cup is cooled and flushed by circulating cooling fluid through an inside the shaft coolant conduit out along the inside magnetically coupled rotor and along and out of the cup. The rotor 11 is the driving part of the magnetic coupling. For simplicity, the cooling and flushing arrangement of the rotor 11 and cup 5C is not illustrated since it would be difficult to see the details in the figure. However, a hollow shaft, or conduits in the shaft, with radial openings out from the shaft, are required for providing said cooling and flushing. A filter in the circulation loop in the motor compartment removes any particles that are flushed out in the closed motor cavity.

FIG. 2 illustrates another pump embodiment of a vertically oriented pump, but where a part of the diaphragm 5 has shape like a hat 5H. In addition to the diaphragm, this embodiment is different from the embodiment illustrated in FIG. 1 with respect to the cooling and flushing. More specifically a rotor 12, the driving part of the magnetic coupling and arranged outside the hat 5H, is cooled and flushed by circulating cooling fluid through coolant conduits arranged inside and outside of the rotor. Conduits for coolant and flushing are also arranged radial inwards in order to cool and flush the hat part of the diaphragm, and through a radial bearing adjacent the external rotor. The circulation system is also used to remove any gas collected in the hat since such gas can come with the pumped process fluid. For simplicity, the cooling and flushing arrangement is not illustrated, since it would be difficult to see the details in the figure, and equipment items similar or identical to the embodiment illustrated in FIG. 1 have no assigned reference numericals, for which reason further reference is made to FIG. 1.

Reference is made to FIG. 3 illustrating a variation of the embodiment illustrated in FIG. 2. More specifically, the "hat" 5H has been extended to cover also the rotor 13 of the motor, and the cooling and flushing arrangement has been modified, and also the bearing arrangement has been modified. The extended hat 5H provides a canned motor, with a stator compartment 4S on one side of the diaphragm 5 and a rotor on the pump shaft in on the other side of the diaphragm, in a pump compartment 3. The rotor on the pump side is preferably arranged with permanent magnets. A separate rotor 14 in the stator chamber, driven by the stator 15, drives a coolant circulation pump CFP providing cooling and flushing onto and around the "hat" and for the bearings in the stator compartment.

The illustrated embodiments have an effective cooling and flushing of critical equipment items and volumes, providing cooling, lubrication and flushing out of gas, sand, metal particles and other contamination from critical components in order to avoid the typical problems mentioned earlier, resulting in an extended service life over prior art subsea sealed pumps. Also, the sealed motor or stator compartment requires no barrier fluid feed, eliminating umbilical feed and topsides hydraulic power unit. The effective pressure compensation, allowing purely mechanical, local pressure compensation without remote supply, allows fast response times with respect to pressure compensation, allowing use of a thin walled high strength diaphragm, allowing reduced distance and hence improved magnetic coupling between the driving and driven parts of the magnetic coupling. The diaphragm can be made of any non-ferromagnetic high strength tough material, such as Monell or composite material. The pump of the invention can comprise any feature as here described or illustrated, in any operative combination, each such operative combination is an embodiment of the present invention.

The invention claimed is:

1. A subsea pump, comprising:

a pressure housing divided into a first compartment and a hermetically-sealed second compartment;

the first compartment having disposed therein at least one of a pump and an impeller, the at least one of a pump and an impeller being arranged on a first shaft for pumping of a process fluid;

the hermetically-sealed second compartment having disposed therein one of a motor and a stator of a motor, the motor comprising a rotor arranged on a second shaft;

a wall arranged sealingly between the first compartment and the second compartment with the first shaft and the second shaft on opposite sides of the wall;

a magnetic coupling between the first compartment and the second compartment, coupling the first shaft and the second shaft through the wall;

a pressure balancing system arranged between the first compartment and the hermetically-sealed second compartment for balancing pressure over the wall between the first compartment and the second compartment;

a cooling fluid pump arranged on one of the second shaft and the rotor;

a hermetically-sealed cooling circuit coupled to and from the second compartment;

a combined liquid for flushing, lubrication and cooling, and filling the hermetically sealed second compartment, the combined liquid being pumped by the cooling fluid pump through the hermetically sealed cooling circuit and at least one bearing positioned within the hermetically-sealed second compartment, the combined liquid for cooling, flushing and lubricating the at least one bearing;

wherein the subsea pump is without an external barrier fluid supply.

2. The subsea pump according to claim 1, wherein the pressure balancing system controls a pressure differential over the wall to be less than 5 bar by balancing the pressures on either side of the wall.

3. The subsea pump according to claim 1, wherein the second compartment is filled with one of water/glycol and oil as the combined liquid for flushing, lubrication, and cooling, said combined liquid flows in a closed circuit including at least one filter.

4. The subsea pump according to claim 1, wherein the subsea pump is vertically oriented and the wall has a shape like a hat, wherein the rotor is cooled by the combined liquid through of radial conduits that are disposed in a bottom portion of the rotor, and wherein conduits for the combined liquid are also arranged through a radial bearing adjacent the rotor.

5. The subsea pump according to claim 1, wherein the subsea pump is vertically oriented and the wall has a shape like a cup, wherein the rotor is cooled by the combined liquid through conduits arranged inside the rotor and radially out through the rotor.

6. The subsea pump according to claim 1, wherein the at least one bearing is arranged axially apart from the magnetic coupling.

7. The subsea pump according to claim 1, wherein the subsea pump comprises a port so that the combined liquid in the second compartment can be filled or exchanged subsea by a Remotely Operated Vehicle.

* * * * *